United States Patent [19]

Wilson

[11] Patent Number: 4,629,864

[45] Date of Patent: Dec. 16, 1986

[54] HOT AIR GUN

[75] Inventor: Peter H. Wilson, Stockton-on-Tee, United Kingdom

[73] Assignee: Black & Decker, Inc., Newark, Del.

[21] Appl. No.: 587,704

[22] Filed: Mar. 8, 1984

[30] Foreign Application Priority Data

Dec. 23, 1983 [GB] United Kingdom ..... 8334366

[51] Int. Cl.[4] ..... F24H 3/00; H05B 1/00

[52] U.S. Cl. ..... 219/374; 219/370; 219/371; 219/373; 34/99

[58] Field of Search ..... 219/368, 369, 370, 371, 219/373, 374, 222; 34/99

[56] References Cited

U.S. PATENT DOCUMENTS

| | | | |
|---|---|---|---|
| 3,147,368 | 9/1964 | Walker | 219/370 |
| 3,219,261 | 11/1965 | Laing | 219/370 |
| 3,260,422 | 7/1966 | Laing | 219/370 |
| 3,284,611 | 11/1966 | Laing | 219/370 |
| 3,298,111 | 1/1967 | Parr | 34/99 |
| 3,348,020 | 10/1967 | Cooper | 219/370 |
| 3,492,462 | 1/1970 | Schumacher | 219/370 |
| 3,612,824 | 12/1969 | Berryman et al. | 219/370 |
| 3,668,370 | 6/1972 | Pattison | 219/373 |
| 3,816,706 | 6/1974 | Meywald | 219/374 X |
| 3,818,600 | 6/1974 | Fischer | 34/99 |
| 3,857,016 | 12/1974 | Meyer et al. | 219/368 |
| 3,885,127 | 5/1975 | Walter et al. | 219/367 |
| 3,927,300 | 12/1975 | Wada et al. | 219/374 X |
| 3,939,850 | 2/1976 | Wahl | 219/368 X |
| 3,943,329 | 3/1976 | Hlavac | 219/367 |
| 3,955,065 | 5/1976 | Chambon | 219/371 |
| 4,039,774 | 8/1977 | Kata et al. | 219/370 |
| 4,122,329 | 10/1978 | Godel | 219/370 |
| 4,135,080 | 1/1979 | Wells, Jr. | 219/370 |
| 4,166,473 | 9/1979 | Bauer et al. | 219/370 X |
| 4,195,217 | 3/1980 | Moller et al. | 219/370 X |
| 4,195,218 | 3/1980 | Walter et al. | 219/370 |
| 4,196,343 | 3/1980 | Han | 219/370 X |
| 4,198,557 | 4/1980 | Crowley | 219/370 |
| 4,198,558 | 4/1980 | Benty | 219/370 |

FOREIGN PATENT DOCUMENTS

| | | |
|---|---|---|
| 785900 | 5/1968 | Canada . |
| 791937 | 8/1968 | Canada . |
| 837738 | 3/1970 | Canada . |
| 989163 | 5/1976 | Canada . |
| 994633 | 8/1976 | Canada . |
| 1124057 | 5/1982 | Canada . |
| 1157259 | 11/1983 | Canada . |
| 803329 | 10/1958 | United Kingdom . |
| 867476 | 5/1961 | United Kingdom . |
| 905176 | 9/1961 | United Kingdom . |
| 918672 | 2/1963 | United Kingdom . |

*Primary Examiner*—E. A. Goldberg
*Assistant Examiner*—M. M. Lateef
*Attorney, Agent, or Firm*—Finnegan, Henderson, Farabow, Garrett & Dunner

[57] ABSTRACT

A Hot Air Gun capable of stripping paint comprising a casing made of a pair of clam-shell members, an electric motor, a fan drivingly connected to the electric motor, heating means comprising a former and a helical heating element projecting outside the casing and defining an air outlet at its ends, and an outer tubular member surrounding the projecting part of the inner tubular member. The inner and outer tubular members are clamped in position by the securing together of the pair of clam-shell members of the casing. Baffle means are provided at the upstream end of the helical heating element for blocking an air flow path inside the element. The exposed surface of the outer tubular member is covered with a plurality of circumferential ribs.

14 Claims, 13 Drawing Figures

HOT AIR GUN

BACKGROUND OF THE INVENTION

1. Field of the Invention

This invention relates to a hot air gun and in particular to a hot air gun such as may be used for stripping paint.

2. Description of Related Art

The most common form of hot air gun is the domestic hair dryer. A hot air gun for stripping paint has to produce a higher temperature airstream and it might be thought that this could be achieved simply by employing a more powerful heating element. In practice, however, it is found that the provision of a more powerful heating element leads to other problems: the extra heat generated by the heating element is not automatically all transferred to the airstream through the tool and therefore the airstream may not reach a sufficiently high temperature: also, because of the larger heating element and particularly if the transfer of heat to the airstream is not very efficient there is a danger that at least part of the tool may become too hot.

British patent specification No. 803,329 describes a hot air gun in which the main stream of hot air passing over the heating element is separated from the outer casing of the tool by an annular space through which a stream of cooling air flows. While the provision of such an annular cooling air flow does assist in preventing the outer casing of the tool becoming too hot, it does not solve the problem entirely. Furthermore, the construction of the various parts making up the hot air gun is such that assembly and dissembly of the tool is a relatively complex and time consuming matter.

It is an object of the invention to provide an improved form of hot air gun capable of stripping paint.

It is a further object of the invention to provide a hot air gun in which the outer casing of the tool has improved cooling means and is not uncomfortably hot to hold.

It is a further object of the invention to provide a hot air gun with improved transfer of heat from a heating element to a stream of air passing over the element.

It is a further object of the invention to provide a hot air gun which is particularly simple to assemble and dissemble.

SUMMARY OF THE INVENTION

According to the invention, there is provided a hot air gun capable of stripping paint and comprising:

a casing made of a pair of clam-shell members,
an electric motor,
a fan drivingly connected to the electric motor,
heating means comprising a former and a helical heating element mounted on the former downstream of the fan,
an inner tubular member closely surrounding the helical heating element, projecting outside the casing and defining an air outlet at its end, and
an outer tubular member surrounding the projecting part of the inner tubular member,
wherein the inner and outer tubular members are clamped in position by the securing together of the pair of clam shell members of the casing.

The use of a clam shell casing clamping inner and outer tubular members results in a construction which is simple to assemble and dissemble while at the same time enabling the exposed parts of the gun to be kept cool.

The electric motor, the fan and the heating means may together define a sub-assembly which is clamped in position by the securing together of the pair of clam shell members of the casing. Such an arrangement further facilitates assembly and dissembly of the gun.

Advantageously, the exposed surface of the outer tubular member is covered with a plurality of ribs which may extend circumferentially around the outer tubular member. This makes the outer member much cooler for an operator to touch since contact with the outer member is limited to contact with the ribs.

Advantageously, baffle means are provided at the upstream end of the helical heating element for blocking an air flow path inside the element. The baffle means may comprise a pair of half-moon baffle elements together defining a circular baffle coaxial with the helical heating element. The provision of such a baffle forces air inclined to flow through the inside of the element to flow through or closely adjacent to the element itself and thus improves heat exchange between the element and the air.

In a preferred embodiment, the casing defines an upper barrel portion and a lower hand grip portion, a rear end wall is provided in the barrel portion defining that part of the barrel furthest from the air outlet, and an air inlet is provided in the casing in a rear portion of the barrel forward of the rear end wall. By providing the air inlet forward of the rear end wall the risk of an operator inadvertently blocking the air inlet, for example by covering over the back of the tool with his hand, is reduced.

According to another aspect of the invention there is provided a hot air gun comprising:

a casing,
an electric motor,
a fan drivingly connected to the electric motor,
heating means mounted downstream of the fan,
an inner tubular member closely surrounding the helical heating element, projecting outside the casing and defining an air outlet at its end, and
an outer tubular member surrounding the projecting part of the inner tubular member and defining an annular air flow path therebetween, the exposed surface of the outer tubular member being covered with a plurality of circumferential ribs.

According to yet another aspect of the invention, there is provided a hot air gun comprising:

a casing,
an electric motor,
a fan drivingly connected to the electric motor,
heating means comprising a former and a helical heating element mounted on the former downstream of the fan,
baffle means at the upstream end of the helical heating element for blocking an air flow path inside the element,
an inner tubular member closely surrounding the helical heating element, projecting outside the casing and defining an air outlet at its end, and
an outer tubular member surrounding the projecting part of the inner tubular member and defining an annular air flow path therebetween.

BRIEF DESCRIPTION OF THE DRAWINGS

By way of example an illustrative embodiment of the invention will now be described with reference to the accompanying drawings of which.

DESCRIPTION OF THE PREFERRED EMBODIMENT

Figure 1:
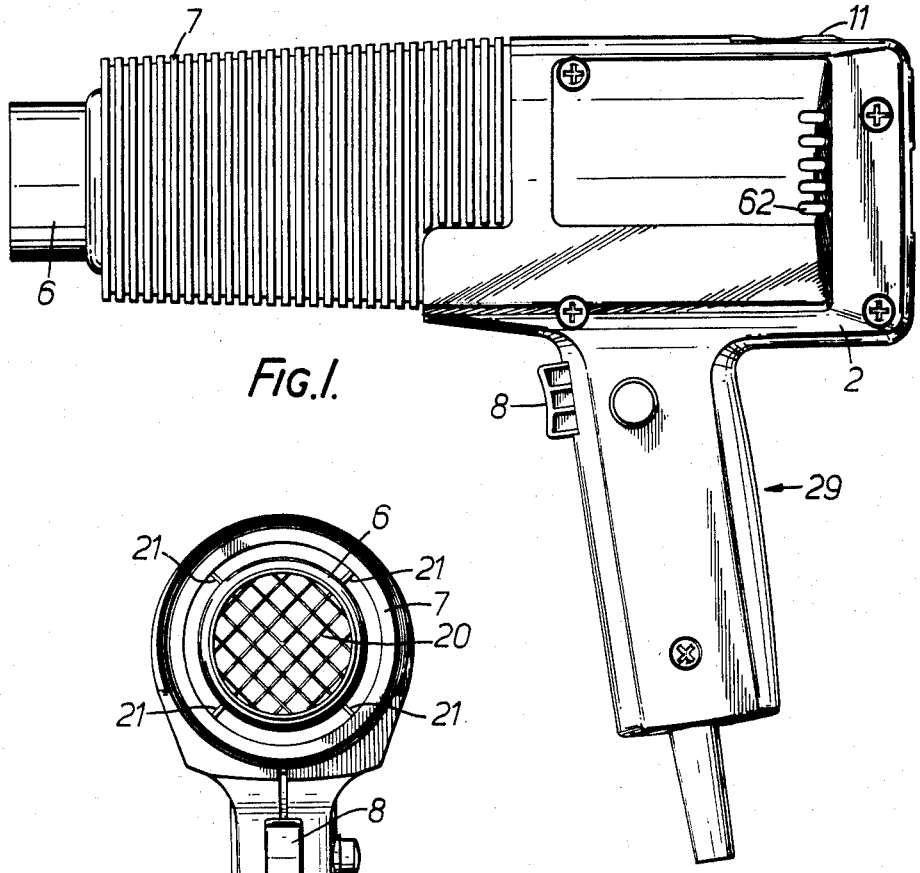
FIG. 1 is a side elevation of a hot air gun.

The hot air gun shown in the drawings is designed primarily for stripping paint.

Referring first to FIGS. 1 to 6, the gun comprises a casing formed by two clam shell halves 1, 2 which mate substantially along the centre line of the tool, an electric motor 3, a printed circuit board 9, a fan 4, a heating element assembly 5, an inner tube 6, an outer tube 7, an operating switch 8, an electric cable 10 for connecting the switch 8 to a power source, and a hanger 11.

Figure 2:
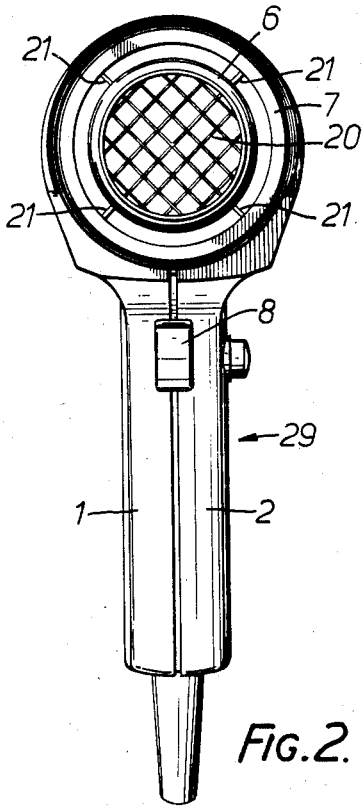
FIG. 2 is a front elevation of the gun.
Figure 3:
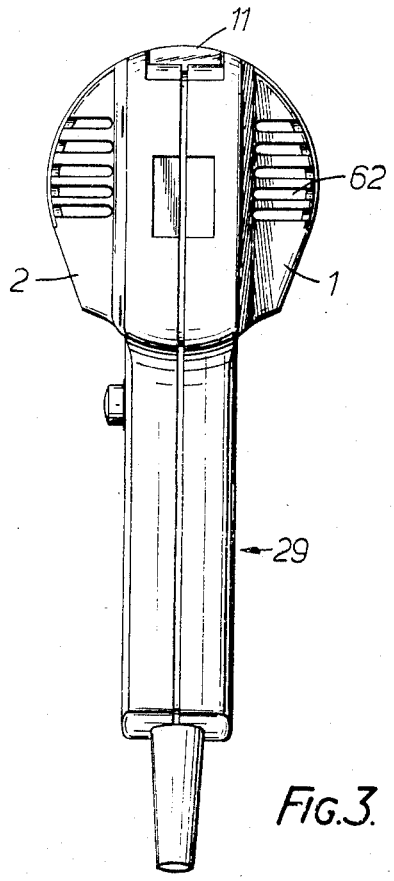
FIG. 3 is a rear elevation of the gun.
Figure 4:
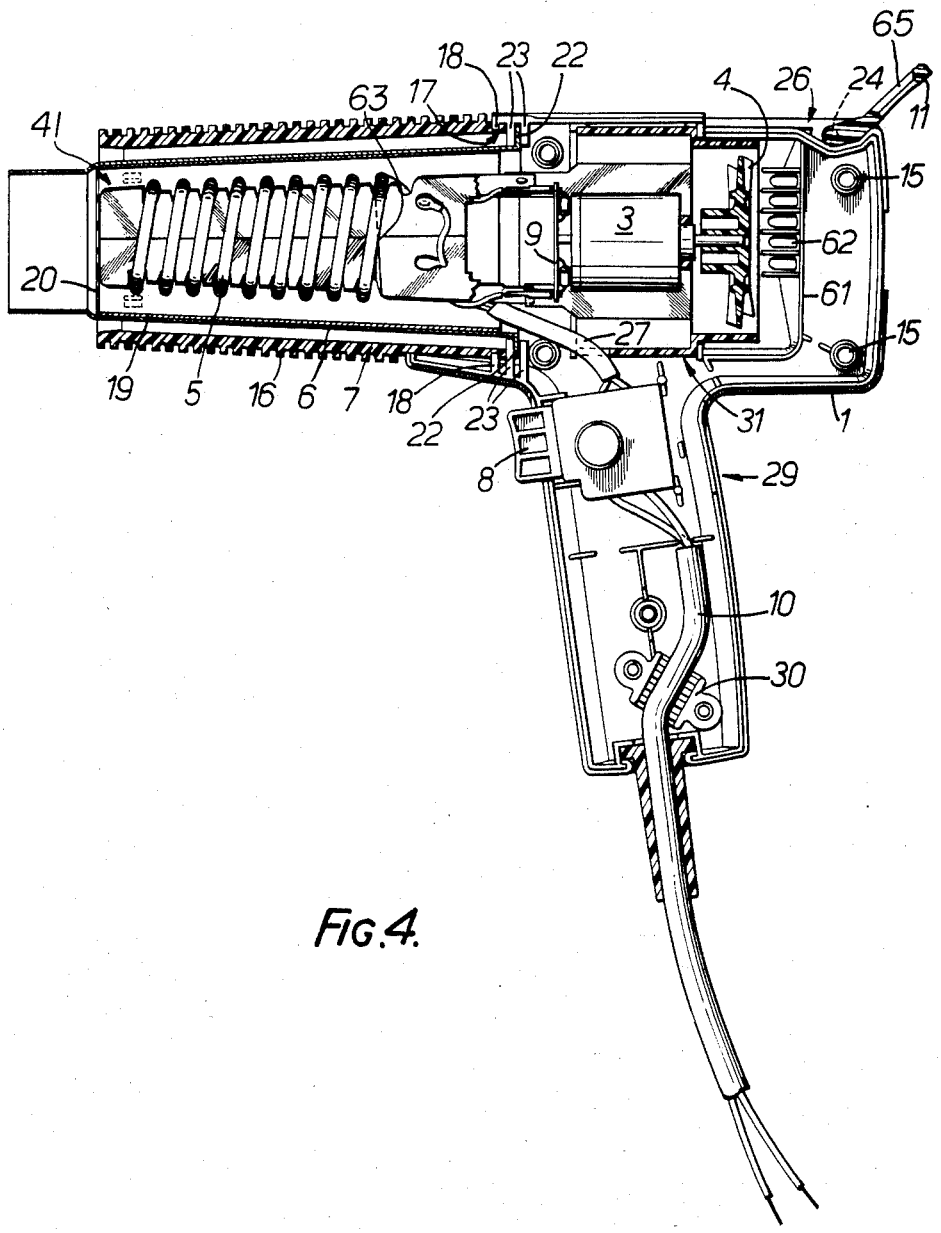
FIG. 4 is a sectional side view of the gun.
Figure 5:
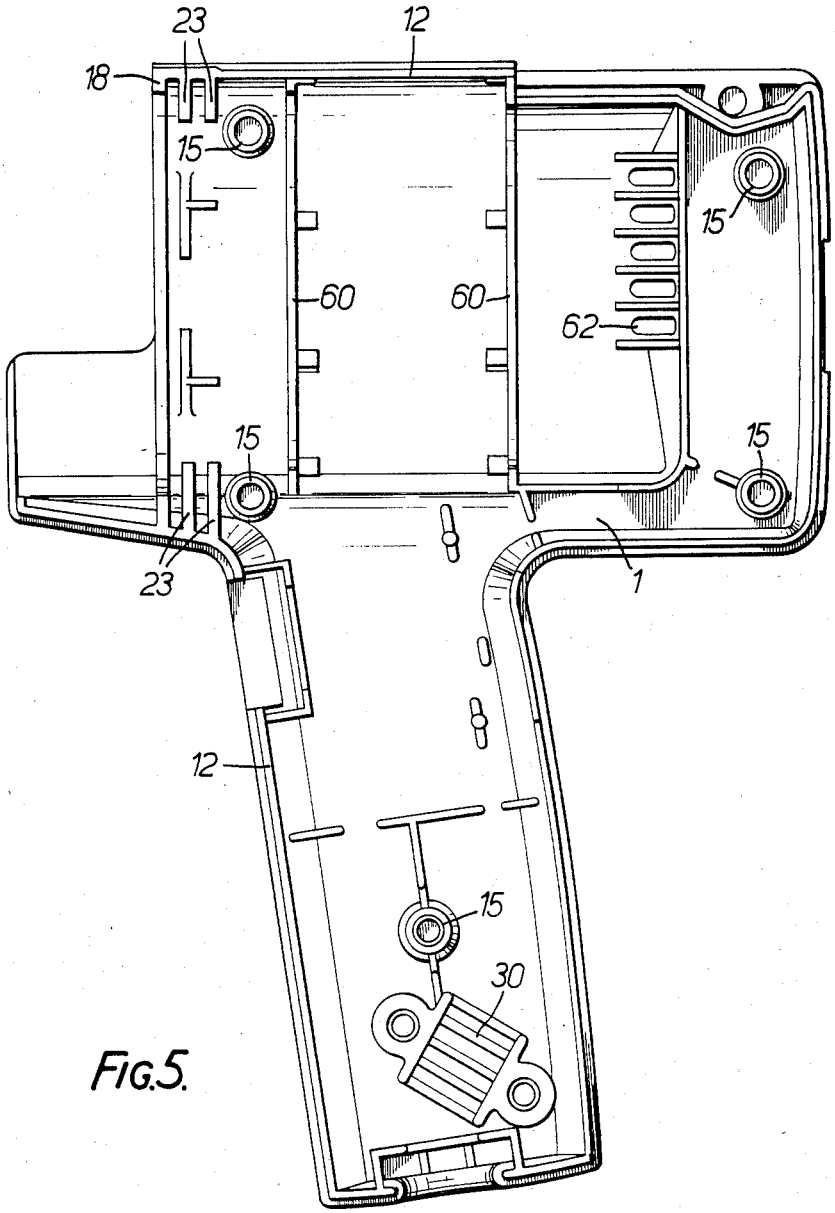
FIG. 5 shows one clam shell half of the casing of the gun.
Figure 6:
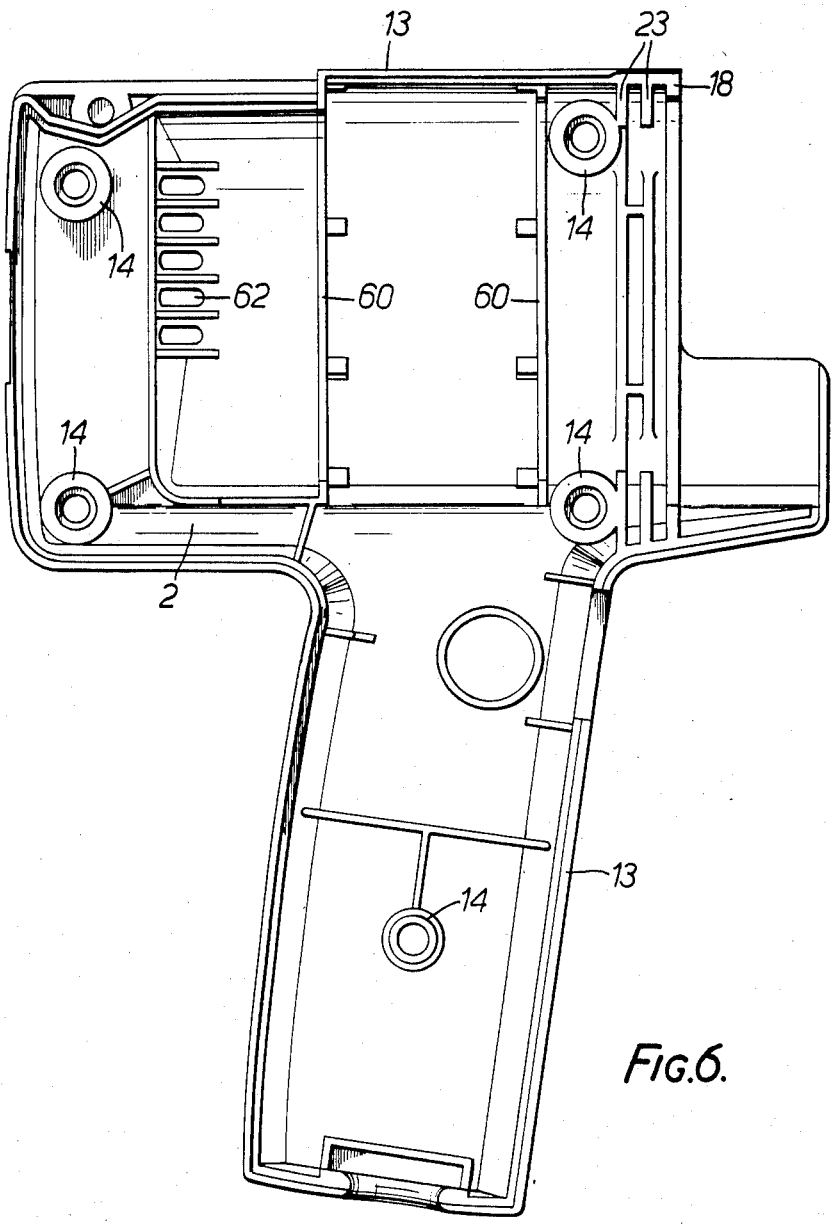
FIG. 6 shows the other clam shell half of the casing of the gun.

As used herein, the term "clam shell" refers to a housing structure wherein two opposed, complementary casing halves are secured together along a centerline to define a cavity in which components of the device are disposed. The two casing halves are depicted in FIGS. 5 and 6 and are joined together as depicted in FIGS. 2 and 3.

The clam-shell halves 1, 2 are each moulded in one piece from plastics material and have formations which locate and clamp all the parts of the gun in position when the two clam-shell halves are screwed together. The clam-shell half 1, seen in FIGS. 4 and 5, has a peripheral flange 12 which projects beyond the centre line of the tool and overlaps on the inside the peripheral wall 13 of the other clam-shell half 2. The clam-shell half 2 has five bosses 14 with holes therethrough and corresponding bosses 15 with blind bores are provided in the clam-shell half 1. The clam-shell halves are clamped together by screws passed through the bosses 14 and screwed into the bosses 15.

The outer tube 7 is made of plastics material and has a slight taper towards its forward end. The outer surface of the tube 7 is provided with a plurality of circumferential ribs 16 which extend full circle around the tube except at a rear end portion of the tube where the lower portion of the tube, which is covered by the clam-shell halves 1, 2, is not ribbed. A circumferential groove 17 is formed in the rear end of the tube 7 and this receives a corresponding flange 18 formed on the clam-shell halves 1, 2 thereby lcoating the tube 7.

The inner tube 6 is made of metal and is lined with an insulating sleeve 19. At the front end of the inner tube a wire mesh grill 20 is provided protecting a user from the heating element. The inner tube 6 has a similar taper to the tube 7 and the forward end of the inner tube 6 is supported in the tube 7 by four inwardly projecting radial lugs 21 on the interior of the tube 7. The rear end of the inner tube 6 has a discontinuous peripheral flange made up of four flange segments 22 equispaced around the periphery of the tube. The flange segments 22 are received in corresponding grooves formed by pairs of walls 23 formed on the clam-shell halves 1, 2 at both sides, the top and the bottom. As seen in FIGS. 5 and 6, walls 23 are also discontinuous whereby walls 23 cooperate with flange segments 22 to define circumferentially spaced passages for axial air flow.

The hanger 11, which has a hole 65 by which it can be hung, is pivotally mounted between the two clam-shell halves 1, 2 by a pair of lugs 24 which are received in corresponding blind bores 25 provided on the clam-shell halves. An external recess 26 is also defined by the clam-shell halves and the hanger is pivotable to a stowed position (shown in FIGS. 1 to 3) in which it is received in this recess.

The upper parts of the clam-shell halves together with the tube 7 define a barrel part of the gun in which a sub-assembly comprising the electric motor 3, the fan 4, the printed circuit board 9 and the heating element assembly 5 are located. This sub-assembly is described in more detail below. Electrical power for the sub-assembly is supplied through a cable 27 connected to the switch 8, which is a lock-on switch, in the top of a handle part 29 of the gun. The electric cable 10 enters the gun through the bottom of the handle, passes through a cable clamping arrangement 30 on the clam-shell half 1 and is connected to the switch 8.

Figure 7:
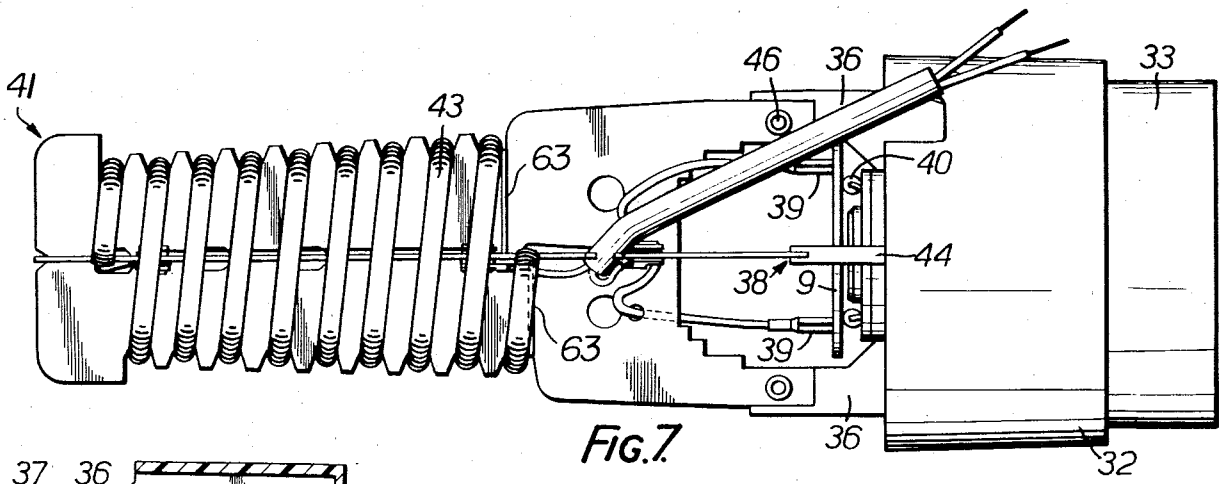
FIG. 7 is a side view of a sub-assembly of the gun, the sub-assembly comprising a motor, a printed circuit board and a heating element assembly.
Figure 9:
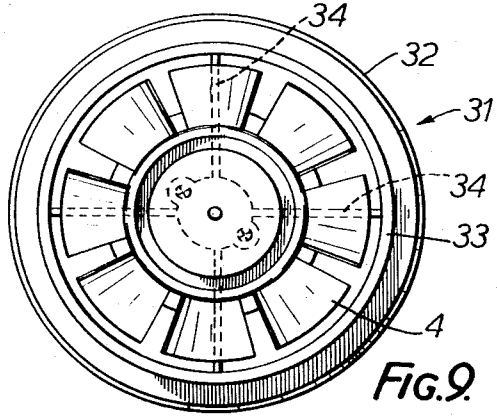
FIG. 9 is a rear end view of the motor and printed circuit board.
Figure 8:
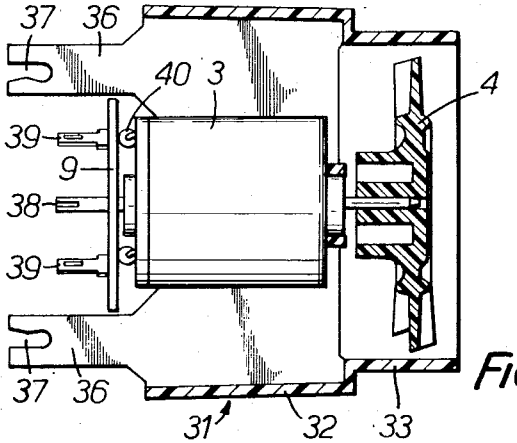
FIG. 8 is a sectional side view of the motor and printed circuit board.

Referring now to FIGS. 7 to 9, the sub-assembly has a body 31 of plastics material. The body 31 has a cylindrical outer part 32 with a reduced diameter rear part 33. Projecting inwardly from the part 32 are four radial walls 34 which are spaced at 90° intervals around the part 32. The walls 34 meet at their rear end defining a spider to which the motor 3 is screwed. Along the rest of their length, the walls 34 lie against the casing of the motor 3 and at their front ends carry integral forwardly projecting legs. The legs are in two pairs. A first pair 36, diametrically opposite one another, have jaws 37 at their free ends, while the second pair 44, also diametrically opposite one another, have slots 38 at their free ends.

Mounted on the front of the motor 3 is the printed circuit board 9 having two terminal connections 39 and four diodes 40 connected in a manner to be described later. The motor 3 is a permanent magnet D.C. motor and has an output drive shaft projecting rearwardly therefrom on which an axial flow fan 4 is press-fitted.

The body 31 is snugly received in the barrel part of the casing formed by the clam-shell halves with the cylindrical outer part 32 of the body 31 fitted between walls 60 formed on the clam-shell halves 1, 2.

The clam-shell halves 1, 2 also have respective 'L' shaped walls 61 to the rear of the fan 4 which together define a chamber behind the body 31 and communicating with the interior of the body 31. Inlet air vents 62 are provided in each clam-shell half in communication with the chamber.

Figure 10:
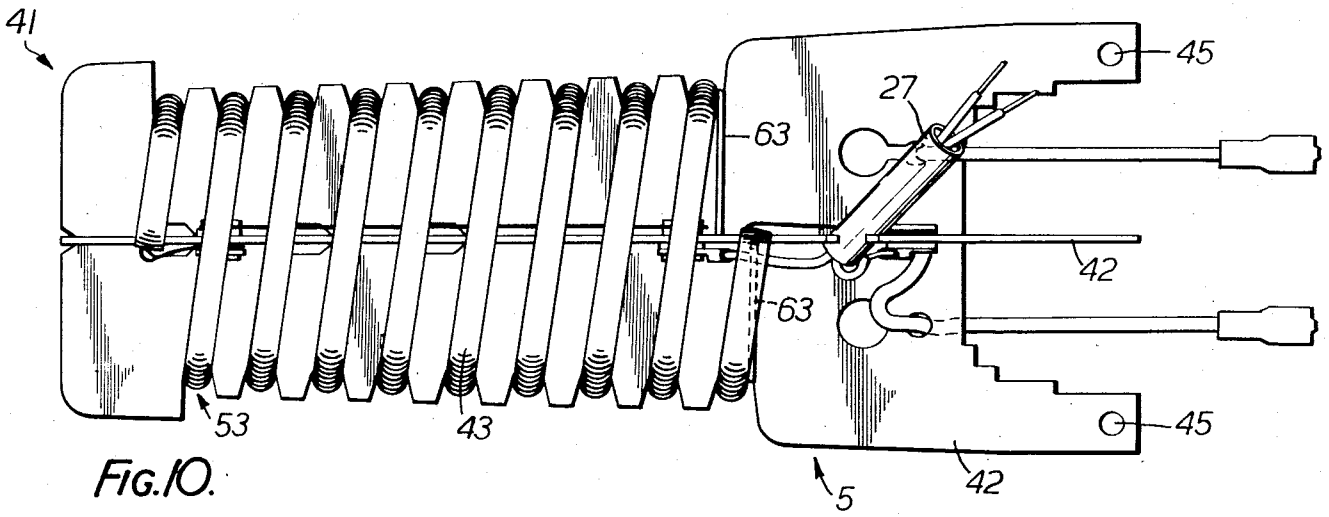
FIG. 10 is a view from one side of the heating element assembly.
Figure 11:
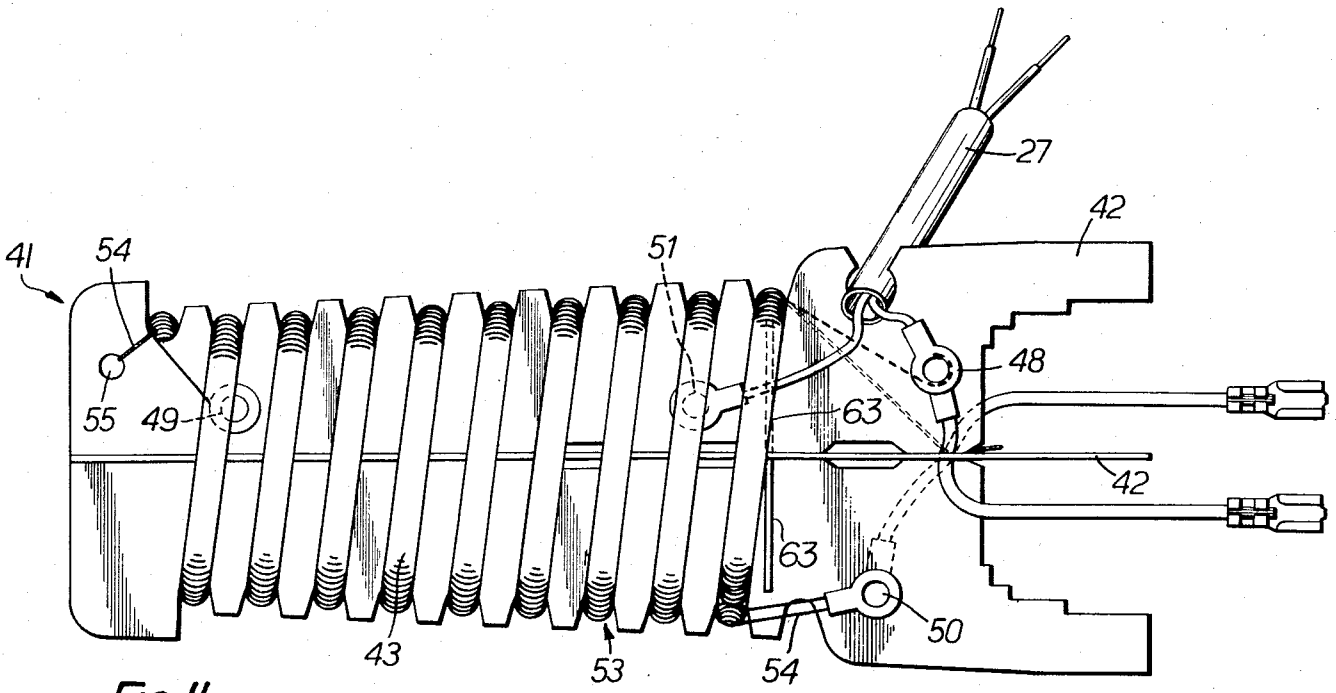
FIG. 11 is a view from another side of the heating element assembly.
Figure 12:
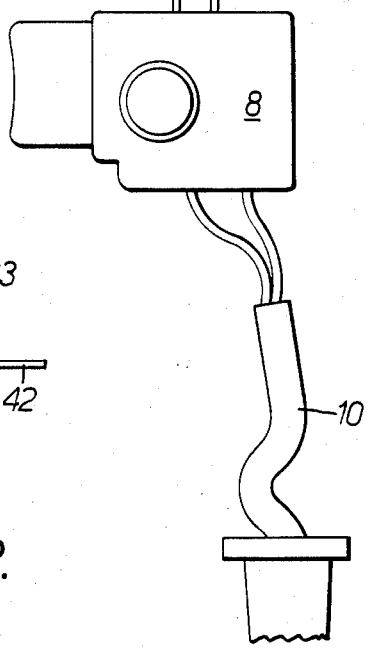
FIG. 12 is a rear end view of the heating element assembly.
Figure 12:
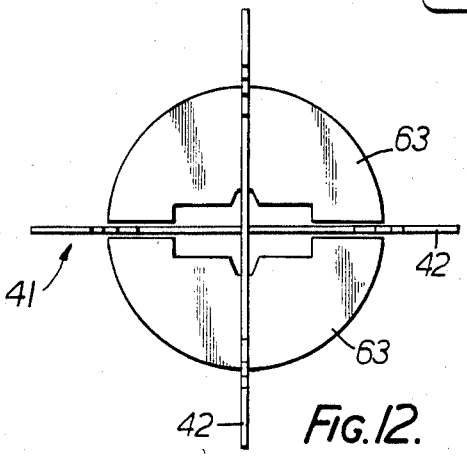

Referring now also to FIGS. 10 to 12, the heating element assembly 5 generally comprises a pair of boards 42 made of heat resistant material, for example mica, and slotted into one another to provide a former 41 on which a heating coil 43 is helically wound. The rear ends of the boards terminate in feet and are mounted on the legs 36, 44 of the body 31 of the sub-assembly. The feet of one board have holes 45 in which rivets 46 (not shown in FIG. 11) are mounted and the rivets snapped into the jaws 37 of the legs 36: The feet of the other board engage the slots 38 formed in the legs 44.

The heating coil 43 extends between a termination 48 at the rear end of the assembly and a termination 49 at the forward end. A short way along the coil from the rear end, it is tapped and a tap termination 50 provided. The termination 49 is connected by a short length of wire running through the centre of the coil to another termination 51 at the rear end of the assembly. The terminations 48, 49, 50 and 51 are all mounted on the boards 42. In addition to the electrical connections already mentioned, the terminations 48 and 51 are connected to respective leads of the cable 27 and the termination 48 is connected to one of the terminal connectors 39 on the printed circuit board 9, and the termination 50 is connected to the other of the terminal connectors 39.

The heating coil 43 is located on the former 41 in grooves 53 formed in the edges of the boards and a heat resistant string 54 is provided through the coil to retain the coil in place in the event of it breaking. The forward end of the string is tied to the former 41 using a hole 55 in the latter and the rear end is wedged in the central slot in one of the boards 42.

At the rear end of the heating coil 43 a pair of half-moon shaped baffle elements 63 (best shown in FIG. 12) are provided. The baffle elements 63 slot into one of the boards 42 of the former 41 perpendicular thereto and, although they are slightly staggered relative to one another, effectively fill in the circular area inside the heating coil 43.

Figure 13:
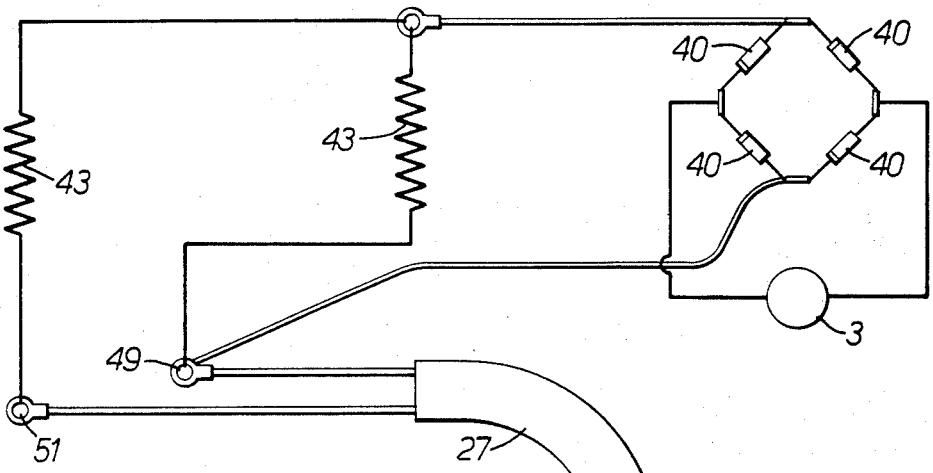
FIG. 13 is an electric circuit diagram of the gun.

FIG. 13 shows the electric circuit diagram of the gun. From this it will be seen that the four diodes 40 provide full wave rectification of the small portion of the mains voltage tapped from the heating coil 43 and this full wave rectified supply is connected to the motor 3.

In use, the electric cable 10 is connected to the mains supply. An operator holds the gun by its handle and squeezes the trigger switch 8 to switch the tool on. Once the switch 8 is closed, power is supplied to the heating coil 43 and the small portion of the main voltage that is tapped from the heating coil is rectified by the diodes 40 and supplied to the motor 3. The motor 3 rotates, driving the fan 4 which draws air through the vents 62 and expels it through the plastics body 31 between the motor casing and the outer part 32 of the plastics body. The main airstream through the body 31 passes through the inner tube 6 but a subsidiary airstream passes through the clam-shell halves 1, 2 and the rear end of the inner tube 6, through the circumferentially spaced passages defined by discontinuous walls 23 and flange segments 22 of the inner tube and through the space between the inner tube 6 and the outer tube 7. The main airstream through the inner tube 6 is forced by the baffle elements 63 to travel down the outer region of the tube and is therefore heated most effectively by the heating coil 43. While the inner tube becomes hot, the subsidiary airstream flowing between the inner and outer tubes maintains the outer tube 7 at a relatively low temperature. Since this outer tube is made of a thermally insulating material, the exposed surfaces of the tube do not become hot and the insulating effect of the outer tube is further enhanced because of the circumferential ribs 16 that are provided on the tube.

Thus the gun is comfortable for a user even when touching the exposed surface of the outer tube 7 and efficient heat exchange between the heating coil 43 and the main airstream is provided. Furthermore, it will be seen that all the parts of the gun are clamped in position in the casing of the gun when the two clam-shell halves are secured together; this facilitates initial assembly of the gun and also subsequent maintenance.

If desired, a safety device may be provided in the barrel of the gun to disconnect the power supply to the heating coil 43 in the event of the barrel of the gun overheating, for example as a result of the inner tube 7 being blocked or the motor 3 failing.

What is claimed is:

1. A hot air gun capable of stripping paint and comprising:

a clam-shell housing defining a cavity, an electric motor disposed in said cavity, a fan in said cavity drivingly connected to the electric motor, heating means comprising a former and a helical heating element mounted on the former, said heating element projecting from said housing downstream of the fan, an inner tubular member generally coaxially surrounding the helical heating element and having opposed first and second ends, said second end being securely clamped within said clam-shell housing, and the first end projecting from the housing and defining an air outlet, and an outer tubular member having opposed first and second ends, said second and being separately clamped by said clam-shell housing, and the first end projecting from the casing in coaxial relation to the inner tubular member, wherein the inner and outer clamped tubular members are circumferentially spaced thereby defining an annular air flow path therebetween.

2. A hot air gun according to claim 1 in which the electric motor, the fan and the heating means together define a sub-assembly which is fixed in said cavity solely by the opposed halves of the clam shell housing.

3. A hot air gun according to claim 2 in which the sub-assembly includes a tubular housing in which the motor is disposed, the motor being spaced from the tubular wall of the housing and the fan being arranged to create an air flow through the tubular housing for cooling the motor.

4. A hot air gun according to claim 1 in which the helical heating element tapers towards its downstream end and the inner tubular member also tapers towards its downstream end.

5. A hot air gun according to claim 1 in which the exposed surface of the outer tubular member is covered with a plurality of ribs.

6. A hot air gun according to claim 5 in which the ribs extend circumferentially around the outer tubular member.

7. A hot air gun according to claim 1 further including baffle means at the upstream end of the helical heating element for generally precluding air flow inside the element and for diverting air flow through an annular space between said heating element and said inner tubular member.

8. A hot air gun according to claim 7 in which the baffle means comprises a pair of half-moon baffle elements together defining a circular baffle coaxial with the helical heating element.

9. A hot air gun according to claim 1 further including a hanger pivotally mounted on the housing for movement between a retracted position in which the hanger is located in a recess in the housing and an operative position in which the hanger projects from the housing.

10. A hot air gun according to claim 1 wherein the housing defines an upper barrel portion and a lower hand grip portion, a rear end wall is provided in the barrel portion defining that part of the barrel furthest from the air outlet and an air inlet is provided in the casing in a rear portion of the barrel forward of the rear end wall.

11. A hot air gun comprising:

a housing, an electric motor disposed in said housing, a fan in said housing drivingly connected to the electric motor, heating means comprising a former and a helical heating element mounted on the former, said heating element projecting from said housing downstream of the fan, an inner tubular member generally coaxially surrounding the helical heating element and having opposed first and second ends, said second being secured within said housing and the first end projecting from the housing and defining an air outlet at its end, and an outer tubular member having opposed first and second ands, said second end being separately affixed to the housing, and the first end projecting from the housing in coaxial relation to the inner tubular member, wherein the inner and outer tubular members are circumferentially spaced thereby defining an annular air flow path therebetween, the exposed surface of the outer tubular member being covered with a plurality of circumferential ribs.

12. A hot air gun capable of stripping paint and comprising:

a housing, an electric motor disposed in said housing, a fan in said housing drivingly connected to the electric motor, heating means comprising a former and a helical heating element mounted on the former, said heating element projecting from said housing downstream of the fan, an inner tubular member generally coaxially surrounding the helical heating element, having opposed first and second ends, said second end being affixed to the housing, and the first end projecting from the housing and defining an air outlet at its end, and an outer tubular member having opposed first and second ends, said second end being affixed to the housing, and the first end projecting from the housing in coaxial relation to the inner tubular member, wherein the inner and outer tubular members are circumferentially spaced thereby defining an annular airflow path therebetween, and baffle means inside the inner tubular member at the upstream end of the helical heating element for diverting air flow through an annular space between the outside of the heating element and the inner tubular member.

13. A hot air gun capable of stripping paint comprising:

a clam-shell housing defining a cavity;

an integral sub-assembly including an electric motor, a fan drivingly connected to said motor, and a helical heating element mounted on a former downstream of said fan, the motor and fan of said sub-assembly being disposed in said cavity with said heating element projecting therefrom, and said sub-assembly being secured in position solely through engagement by cooperating components of the opposed halves of said clam-shell housing;

an inner tubular member coaxially disposed around said heating element and having a first end securely clamped between cooperating components of the opposed halves of said clam-shell housing and a second end defining an air outlet; and an outer tubular member coaxially disposed around said inner tubular member and having a first end securely clamped between cooperating components of the opposed halves of said clam-shell housing;

said inner and outer tubular members defining an annular air flow passage.

14. A hot air gun capable of stripping paint comprising:

a housing defining a cavity having an open end;

electrical means in said cavity for generating air flow between inlet ports in said housing and said open end;

a helical heating element projecting from said open end in the path of said air flow;

an inner tubular member coaxially surrounding said heating element and defining a first annular passage around said heating element, said inner tubular member having a first end fixed proximate the periphery of the opening in said housing and a second end defining an air outlet;

baffle means upstream of said heating element for diverting said air flow into said first annular passage;

an outer tubular member coaxially surrounding said inner tubular member and defining a second annular passage, said outer tubular member having a first end fixed proximate the periphery of the opening in said housing and a second end defining an outlet for said second annular passage; and means at the opening in said housing for conducting a portion of said air flow into said second annular passage.

* * * * *